US006889464B2

(12) United States Patent
Degerness

(10) Patent No.: US 6,889,464 B2
(45) Date of Patent: May 10, 2005

(54) COMPOSITE STRUCTURAL MEMBER

(76) Inventor: Michael K. Degerness, 6444 Ballard Ave., Lincoln, NE (US) 68507

( * ) Notice: Subject to any disclaimer, the term of this patent is extended or adjusted under 35 U.S.C. 154(b) by 0 days.

(21) Appl. No.: 10/454,165

(22) Filed: Jun. 4, 2003

(65) Prior Publication Data

US 2004/0244257 A1 Dec. 9, 2004

(51) Int. Cl.[7] ..... F41A 21/00

(52) U.S. Cl. ..... 42/76.02; 42/76.01; 89/15; 89/16

(58) Field of Search ..... 42/76.01–76.02; 89/15, 16, 191.01, 192–193

(56) References Cited

U.S. PATENT DOCUMENTS

| | | | | | |
|---|---|---|---|---|---|
| 2,223,671 | A | * | 12/1940 | Brondby | 89/193 |
| 2,249,899 | A | | 7/1941 | Hogg | |
| 2,847,786 | A | * | 8/1958 | Day et al. | 42/76.01 |
| 2,870,685 | A | * | 1/1959 | Harvey | 89/193 |
| 2,935,913 | A | | 5/1960 | Wilson | |
| 3,004,361 | A | | 10/1961 | Hammer | |
| 3,236,155 | A | | 2/1966 | Sturtevant | |
| 3,350,807 | A | * | 11/1967 | Monroe | |
| 3,359,860 | A | * | 12/1967 | Muhlemann | 89/193 |
| 3,571,962 | A | | 3/1971 | Eig | |
| 3,742,640 | A | | 7/1973 | Thomsen | |
| 4,211,146 | A | | 7/1980 | Bradley | |
| 4,435,455 | A | * | 3/1984 | Prewo et al. | 89/16 |
| 4,536,982 | A | | 8/1985 | Bredbury et al. | |
| H000082 | H | * | 7/1986 | Dittrich et al. | 42/76.02 |
| 4,646,615 | A | | 3/1987 | Gladstone et al. | |
| 4,649,797 | A | | 3/1987 | Elspass | |
| 4,655,866 | A | | 4/1987 | Ferrier | |
| 4,663,875 | A | | 5/1987 | Tatro | |
| 4,669,212 | A | | 6/1987 | Jackson | |
| 4,685,236 | A | * | 8/1987 | May | 42/76.02 |
| 4,703,826 | A | | 11/1987 | Byron | |
| 4,729,806 | A | | 3/1988 | Stein | |
| 4,769,938 | A | | 9/1988 | Chesnut et al. | |
| 4,841,836 | A | | 6/1989 | Bundy | |
| 4,982,648 | A | | 1/1991 | Bol et al. | |
| 5,054,224 | A | | 10/1991 | Friar et al. | |
| 5,125,179 | A | * | 6/1992 | Campbell et al. | 42/76.02 |
| 5,191,165 | A | * | 3/1993 | Oskarsson et al. | 89/15 |
| 5,214,234 | A | * | 5/1993 | Divecha et al. | 89/16 |
| 5,285,592 | A | * | 2/1994 | Sides | 42/76.02 |
| 5,348,598 | A | * | 9/1994 | Vives et al. | 89/15 |
| 5,400,691 | A | | 3/1995 | Suttie et al. | |
| 5,600,912 | A | * | 2/1997 | Smith | 42/76.02 |
| 5,657,568 | A | | 8/1997 | Christensen | |
| 5,692,334 | A | | 12/1997 | Christensen | |
| 5,804,756 | A | * | 9/1998 | Christensen | 89/16 |
| 5,831,202 | A | * | 11/1998 | Rustick | 89/193 |
| 5,837,921 | A | | 11/1998 | Rinaldi et al. | |
| 5,915,937 | A | * | 6/1999 | Christensen | 42/76.02 |
| 5,945,626 | A | | 8/1999 | Robbins | |
| 6,102,112 | A | | 8/2000 | Herzl | |
| 6,167,794 | B1 | | 1/2001 | Kathe | |
| 6,189,431 | B1 | * | 2/2001 | Danner et al. | 89/16 |
| 6,230,429 | B1 | | 5/2001 | Smith | |
| 6,311,602 | B1 | | 11/2001 | Gerber et al. | |
| 6,314,857 | B1 | | 11/2001 | Schmidt et al. | |
| 6,457,274 | B2 | * | 10/2002 | Smith | 42/76.02 |
| 6,482,248 | B1 | | 11/2002 | Holloway | |
| 6,497,065 | B1 | | 12/2002 | Huston | |
| 6,508,159 | B1 | | 1/2003 | Muirhead | |

FOREIGN PATENT DOCUMENTS

| | | | | |
|---|---|---|---|---|
| EP | 602 877 A1 | * | 6/1994 | 42/76.02 |

* cited by examiner

*Primary Examiner*—Michael J. Carone
*Assistant Examiner*—Lulit Semunegus

(57) ABSTRACT

To make a composite gun barrel, an inner barrel of a hard refractory material is formed and a composite jacket formed over it to increase the stiffness and strength while not adding excessive weight. The tows in the external jacket are varied in pitch along the barrel to decrease the amplitude of vibrations of a muzzle during firing. High thermal conductivity material is added to the resin to increase thermal conductivity. In the preferred embodiment, the thermally conductive material is chopped pitch-based carbon fibers and these are randomly oriented. A gas port is added and shielded from the composite material and a metal muzzle piece protects the composite from hot gases.

33 Claims, 5 Drawing Sheets

COMPOSITE STRUCTURAL MEMBER

BACKGROUND OF THE INVENTION

This invention relates to composite structures such as for example composite firearm barrels.

It is known to construct strong, light structures using composite materials such as for example light weight but stiff barrels for firearms. In one known type of composite structural member, a central member is reinforced by an outer composite jacket comprised of strands or tows embedded in a resin. In some such structures, at least some of the tows are helically wound about the central member. One type of composite gun barrel includes an inner tubular member of a hard material such as steel forming and enclosing the bore of the barrel and an outer jacket of a composite material that includes tows helically wound about the inner tubular member.

In some prior art composite gun barrels, the jacket has several layers with the tows in each layer having a different winding angle and/or some other different property or properties intended to enhance a particular characteristic such as bursting strength, torsional stiffness or bending stiffness. One such prior art patent is U.S. Pat. No. 4,685,236 to Sam May. In this type of prior art gun barrel, the composite jacket and the liner are substantially uniform along their length or have only gradual changes in diameter of the composite jacket.

This prior art type of gun barrel has several disadvantages such as for example: (1) its accuracy is reduced by excessive variations in the angle the muzzle is pointing at the moment of exit of the projectile caused by high amplitude vibrations at the muzzle end of the barrel; and (2) some embodiments are excessively susceptible to overheating during use. In the prior art, the muzzle angle is stabilized by trimming the length of the barrel to a point where the muzzle is at a node of low amplitude vibrations. However, this technique is time consuming and difficult.

Some prior art structural members such as the shafts of golf clubs are formed of composite materials with the fibers wound in helixes having a winding angle that changes along the shaft and with multiple winding angles on different layers to control the kick point along the shaft and suppress reflected vibration from the grip of the club. Two such patents are U.S. Pat. No. 4,319,750 to Roy and U.S. Pat. No. 4,157,181 to Cecka. These patents are not adapted to use for barrels or for devices in which there is a gas propelled projectile to be expelled from a muzzel or which require the dissipation of heat.

The prior art composite barrels commonly include a liner as the tubular member forming the bore of the firearm with its internal walls. The liner is usually too thin to be used alone as a barrel in the firearm without reinforcement. This type of composite barrel has the disadvantage of having poorer burst strength, poorer thermal conductivity along and through the barrel and wider vibrational swings of its muzzle end.

To reduce vibration, one type of prior art composite barrel couples the composite to the steel lining more tightly by compressing the composite against the steel liner to cause the vibrations to be absorbed in the matrix. Some also align the tows with the barrel so that longitudinal vibrations compress the tows in the direction of low resistance and extend the tows by releasing the compression along their length so the vibrations are absorbed and attenuated in the resin matrix. However, these measures under some circumstances do not sufficiently reduce vibrations. The use of tows aligned with the longitudinal axis of the bore also has the disadvantage of reducing the resistance to radial pressure as compared to the composites having tows cylindrically or helically wound or formed in a plane perpendicular to the longitudinal axis of the barrel thus requiring a thicker inner tube or more reinforcement. Prior art firearms with composite barrels have generally not been gas operated. This is because the composite jacket would be exposed to hot gas and heat to the extent that the composite would be degenerated, in fast firing weapons. Moreover, in some such structures, the thermal coefficients of expansion are incompatible resulting in structural weaknesses and faults during temperature changes.

Some prior art composite structures include thermally conductive primary metallic base materials such as titanium metallic materials. An example of such a composite material is disclosed in U.S. Pat. No. 6,284,389 to Jones et al., granted Sep. 4, 2001. However, such composite materials have not been used in conjunction with firearm barrels although the need for controlling the heating of firearm barrels has long been known and thermally conductive materials have long been known. One difficulty in adding conductive materials to composite firearm barrels is that some such materials increase the viscosity or change other characteristics of the composite in a manner that makes winding of the tows difficult or alters the ability of the composite jacket to maintain its integrity under high temperatures. For example, some high thermal conductivity tows have a coefficient of thermal expansion that is negative and so large as to cause separation of the jacket and the liner if used.

SUMMARY OF THE INVENTION

Accordingly, it is an object of the invention to provide a novel composite structure.

It is a still further object of the invention to provide a composite structure with better heat characteristics.

It is a still further object of the invention to provide a composite structure with better vibrational characteristics.

It is a still further object of the invention to provide a novel barrel for a gun.

It is a still further object of the invention to provide a novel composite barrel for a gun.

It is a still further object of the invention to provide a novel gas operated firearm.

It is a still further object of the invention to provide a novel composite barrel for a gas operated firearm.

It is a still further object of the invention to provide a structural member, the parts of which have compatible thermal coefficients of expansion.

It is a still further object of the invention to provide a novel composite gun barrel.

It is a still further object of the invention to provide a novel barrel for apparatuses such as small caliber firearms and artillery that propel projectiles.

It is a still further object of the invention to provide a composite barrel that is less subject to becoming ineffective because of excessive heating than some prior art barrels.

It is a still further object of the invention to provide a barrel that avoids excessive vibrational characteristics of the muzzle.

It is a still further object of the invention to provide a composite barrel that reduces the degradation of the composite jacket from hot gases.

It is a still further object of the invention to provide a composite barrel with reduced vibration from the firing of the projecting apparatus.

It is a still further object of the invention to provide a composite barrel that enables a more accurate and reproducible path for the projectile.

It is a still further object of the invention to provide a novel gas operated gun with a composite barrel.

It is a still further object of the invention to provide a novel composite barrel with reduced tendency for the composite to be degraded by hot gases.

It is a still further object of the invention to provide a novel resin mixture which when used will provide high heat transfer to a composite structure.

It is a still further object of the invention to provide a novel method for preparing a resin for use in composite structures.

In accordance with the above and further objects of the invention, a structural member includes a composite portion having fiber tows positioned to increase the angular stability of the muzzle during firing. This is done by varying the pitch of the windings along the barrel to increase absorption of vibrations or to convert the energy of the vibrations to other forms of energy or to change the vibrational wavelength so that the muzzle is at a relatively stationary vibrational node. The material is selected to have a coefficient of thermal expansion compatible with the non-composite portions of the structure and to have good thermal conductivity.

The thermal conductivity of the composite jacket is increased by adding conductive material until the jacket has an average thermal conductivity at least in the vicinity of the breech no lower than 75 watts per meter per degree Kelvin and is about 90 watts per meter per degree Kelvin in the preferred embodiment. It should be in this range throughout the length of the composite jacket. Preferably it will have a thickness between 0.125 inches and 0.3 inches and the underlying hard tube has a value of thickness of between 0.095 inches and 0.2 inches except at the breech where it has a value of thickness substantially over 0.2 inches. Preferably the conductive material will have a coefficient of thermal conductivity no less than 125 watts per meter per degree Kelvin and in the preferred embodiment is in the range of 400 to 700 watts per meter per degree Kelvin.

In the preferred embodiment, the conductive material includes chopped fibers made from pitch carbon sold under the trademark DKD, designated as DKD-X by Cytec Fiberite, 1300 Revolution Street, Havre de Grace, MD 21078. Preferably, at least some of the fibers are oriented in a substantially radial direction to conduct heat away from the central tubular member to the surface of the composite jacket. In the preferred embodiment, the fibers are randomly oriented for convenience in preparation of the composite. The tows are preferably of PAN (polyacrylonitrile) based fibers but may be mixtures of PAN and pitch based fibers or mixtures of pitch-based fibers and boron fibers or pitch-based fibers and boron fibers to arrive at a suitable coefficient of thermal expansion while providing good thermal conductivity properties.

The fiber tows form at least one layer with a helical pitch that varies along the length of the composite barrel in a manner to reduce resonance and standing waves, to maximize absorbency within the resin matrix and cause the muzzle to be at a low amplitude vibration node and thus a low amplitude at the moment the bullet exits the muzzle. The composite jacket may include several layers and the layers may have different patterns of winding angles or wrap speeds. Preferably at least one layer of a plurality of layers of continuous fiber includes a layer with one of an accelerating or decelerating helix pattern of greater than 5 degrees to less than 89 degrees and preferably between 15 degrees and 28 degrees to the axis of the barrel. However it is possible to have a range from 90 degrees to parallel but not desirable. A plurality of said helical layers are intermixed with consolidating hoops lying substantially in a plane orthogonal to the longitudinal axis of the barrel. In the preferred embodiment, the more acute angles are near the muzzle end of the barrel and the more obtuse angles are at the breech end of the barrel. This provides greater bursting strength near the breech and greater tensile stiffness near the nozzle.

In the preferred embodiment, the barrel further includes a muzzle piece of metallic material to protect the composite matrix and provide for accessory threads. The muzzle piece may be a separate tubular member or intrinsically formed with the barrel. The metallic breech area of the barrel is long enough and has enough metallic material to allow for major chamber modifications, commonly known to those skilled in the art, as setting back a barrel for re-chambering. The inner barrel has sufficient mass to withstand peak pressure caused by the firing of the intended cartridge. The barrel in the preferred embodiment is self supporting. In some embodiments, a gas port is connected through a gas tube that extends between the gas port and an operating system. The gas tube includes a refractory wall between the gas port and the operating system to form a protective pathway for gas that reduces the erosion of the composite overlay. The refractory material may be steel, tungsten carbide or a ceramic.

The resin is formed by mixing a high thermal resistance resin with thermally conductive material while maintaining the viscosity of the mixture at a level suitable for use in a winding machine. Preferably, the viscosity should be lower than 9,500 cP (centipoise) and in the preferred embodiment is 8700 cP at 25 degrees centigrade. Preferably, fibers are used rather than powder because the needed amount of conductive material in conductive powder form, in most embodiments, increases the viscosity to an undesirable level and prevents efficient operation of the winding machine. The resin-conductive material mixture is agitated to prevent settling of the conductive material so it is substantially random when applied to the barrel with the tows.

From the above description, it can be understood that the composite barrel and method of making the composite barrel of this invention has several advantages, such as: (1) it improves accuracy and reduces the amplitude of vibrations at the muzzle; (2) it aids in the dissipation of heat and reduces the tendency of the barrel to overheat; (3) it can be formed reliably and predictably with desirable characteristics in an economical manner.

BRIEF DESCRIPTION OF THE DRAWINGS

The above noted and other features of the invention will be better understood from the following detailed description when considered in connection with the drawings in which.

DETAILED DESCRIPTION

Figure 1:
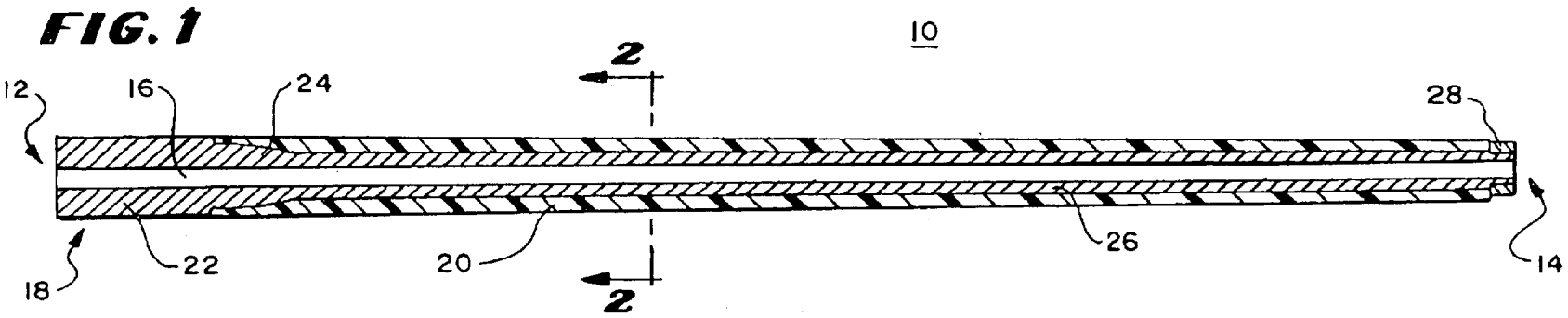
FIG. 1 is a longitudinal sectional view of a composite structural element which in the preferred embodiment is a composite gun barrel.

In FIG. 1, there is shown a longitudinal sectional view of a composite structural element 10, which in the preferred embodiment is a gun barrel having a breech end 12, a muzzle end 14, an inner tubular liner or shell 18, a composite jacket or overlayer 20 and a muzzle piece 28. In the preferred embodiment, the inner tube 18 is a shell or profile of steel or other hard refractory material such as for example titanium or a ceramic or tungsten carbide. It has internal walls forming a central longitudinally extending bore 16 which may have rifling on the inside. In the preferred embodiment, the inner tube 18 is thick enough to be self supporting and capable of serving as a barrel without the composite jacket or overlayer 20. With this thickness, it may have portions that are the full size of a normal barrel and portions that have been reduced in size for lightness, with the reduced size portions having a composite jacket 20 to increase the stiffness, strength and heat conducting ability. It is desirable for the thickness to be 90 thousandths or greater and able to withstand a pressure of at least 70,000 pounds per square inch which is the peak pressure. Although the thickness depends on the material so that 90 thousandths is suitable for 4140 chrome moly steel but 0.1 inch thickness is more desirable when using 416 stainless steel.

The inner tubular shell 18 has a full diameter section shown at 22 in the breech end of the barrel, a transition section 24 as it narrows downwardly to a reduced outer diameter section 26 ending in the tubular muzzle end piece 28. The tubular muzzle end piece 28 shields the composite material from hot gases escaping the end 14 of the muzzle. It is a small tubular fixture of any shape to provide a corrosion and temperature resistant member between the end of the muzzle and the composite material. The wider breech end 12 permits re-chambering if necessary in a manner known in the art. The reduced section 26 has a generally roughened surface to more firmly grip the composite material, which is cured in place in a manner known in the art.

The composite overlayer 20 is formed of a resin with tows embedded in it in a series of helical patterns and circumferential or hoop patterns that provide increased stiffness and strength to the structural element by providing longitudinal and radial strength in tension against the tows in a manner known in the art. The composite overlayer or jacket 20 also provides a high heat conductivity path to the outside of the barrel for rapid conduction of heat to prevent overheating in the case of a firearm barrel.

The tows are positioned to minimize the vibrations of the muzzle that cause it to direct the projectile at an angle other than that intended. The vibrations are reduced by attenuation and the muzzle is caused to be at a low amplitude node by varying the winding angle of the tows along the length of the barrel. By varying the winding angle, the location of the attenuation of the force of the vibrations being propagated in different directions along and between the torsional direction, radial direction and longitudinal direction is changed along the length of the barrel. These changes can be manipulated during formation of the composite to shift the vibrational nodes and alter the amplitude of the vibrations. For convenience and reproducibility, these changes are made by varying the wrapping speed of a winding machine to vary the winding angle as the tows are being helically wound about the inner tubular liner or wall 18 of the barrel. Once a programmed pattern of wrapping speeds is found to provide optimum accuracy for firing, this pattern can be repeated for a given barrel under production.

Figure 2:
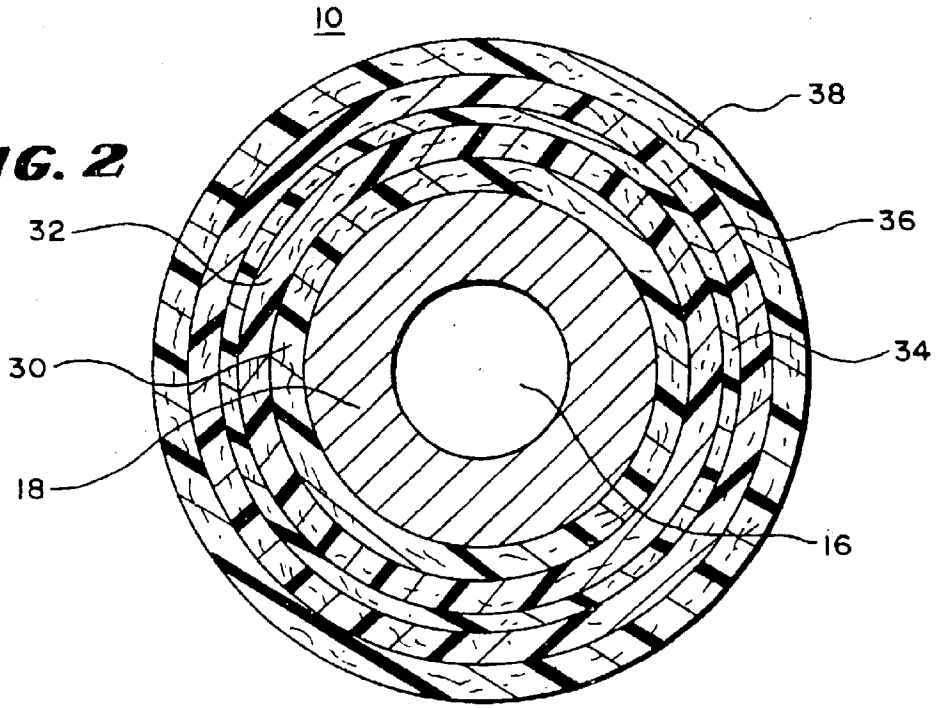
FIG. 2 is a transverse sectional view through lines 2—2 of FIG. 1.

In FIG. 2, there is shown a transverse sectional view through lines 2—2 of FIG. 1 showing the internal bore 16, the inner tubular liner or wall 18 of hard material such as for example steel and five layers of composite material 30, 32, 34, 36 and 38. Each of the layers of composite material in the preferred embodiment has helical and circumferential winding with the helical windings varying along the length. For convenience in production, the helical windings change in one direction in one layer and may change in another direction in another layer, generally proceeding in steps with one pitch for a short distance and then another pitch. These pitches and layers are chosen to prevent harmonics and subharmonics from creating a high amplitude node with wide ranges of deflection at the muzzle. The maximum amplitude node occurs under propagation conditions in which all of the vibrations move the muzzle in the same direction and the minimum occurs when the vibrational forces work against each other as to the deflection of the muzzle, the forces in the bursting direction of the barrel, the torsional forces and the longitudinal forces.

In addition to having helical windings with different pitches, the resin has imbedded within it highly conductive material. Preferably this material is in the form of discontinuous strands such as fibers made from pitch carbon fibers sold under the trademark DKD, designated as DKD-X by Cytec Fiberite, 1300 Revolution Street, Havre de Grace, Md. 21078. In the most effective arrangement, they would be radial and concentrated near the chamber but for manufacturing convenience, they are randomized in orientation and uniformly distributed so as to, in some instances, form highly conductive paths to the surface of the barrel.

Sufficient conductive material is added until the jacket 20 has an average thermal conductivity at least in the vicinity of the breech 12 no lower than 75 watts per meter per degree Kelvin and is about 90 watts per meter per degree Kelvin in the preferred embodiment. It should be in this range throughout the length of the composite jacket 20 (FIG. 1). Preferably the jacket 20 has a thickness between 0.125 inches and 0.3 inches and the underlying hard tube has a value of thickness of between 0.095 inches and 0.2 inches except at the breech 12 where it has a value of thickness substantially over 0.2 inches. Preferably, the conductive material has a coefficient of thermal conductivity no less than 125 watts per meter per degree Kelvin and, in the preferred embodiment, is in the range of 400 to 700 watts per meter per degree Kelvin. The tows are preferably of PAN (polyacrylonitrile) based fibers but may be mixtures of PAN and pitch based fibers or pitch-based fibers and boron fibers to arrive at a suitable coefficient of thermal expansion while providing good thermal conductivity properties.

The fibers are added to the mixture in the ratio of 0.01 to 0.4 pounds of fiber to 1 pound of resin. The tows themselves can be of the highly conductive material to cause a ratio of conductive material to nonconductive material of as high as three to two by volume but with known materials, care must be taken to avoid problems because of the high negative coefficient of thermal expansion with some conductive materials if they are used in tows. In the preferred embodiment, the tows are not made of highly thermal conductive materials. Because the tows cannot penetrate to the surface, they are less effective in the radial distribution of the heat but more effective in the longitudinal distribution throughout the resin. Thus the combination of highly thermal conductive helical and radial strands with the randomly oriented strands, some of which are nearly radial in direction, provides an effective mechanism for heat transfer from the interior of the barrel to the surface to provide equilibrium at a lower temperature. Other fibers are available under the trademark Cytec DKD-X from Cytec Carbon Fibers, LLC; 7139 Augusta Rd. Piedmont, S.C. 29673.

It is desirable for the resin to have high heat tolerance such as 200 degrees Centigrade. Several epoxy-novolac resins are suitable such as Lindau epoxy novolac sold by Lindau Chemicals 731 Rosewood Drive, Columbia S.C. 29201 under the trademark, Lindoxy, for the basic resin and under the trademark, Lindride 25, for the curing agent. Another is sold under the trademark Si-ZG5A by the A.T.A.R.D. Laboratory division of Shade Incorporated, 5049 Russell Circle, Lincoln, Nebr. With this mixture of epoxy and conductive fiber, the temperature of the barrel will cool to less than 100 degrees Celsius within the first few seconds after firing. This is the appropriate combination of heat spreading throughout the barrel through the highly conductive tows and discontinuous fibers with rapid conduction to the surface for removal by radiation and convection.

Figure 3:
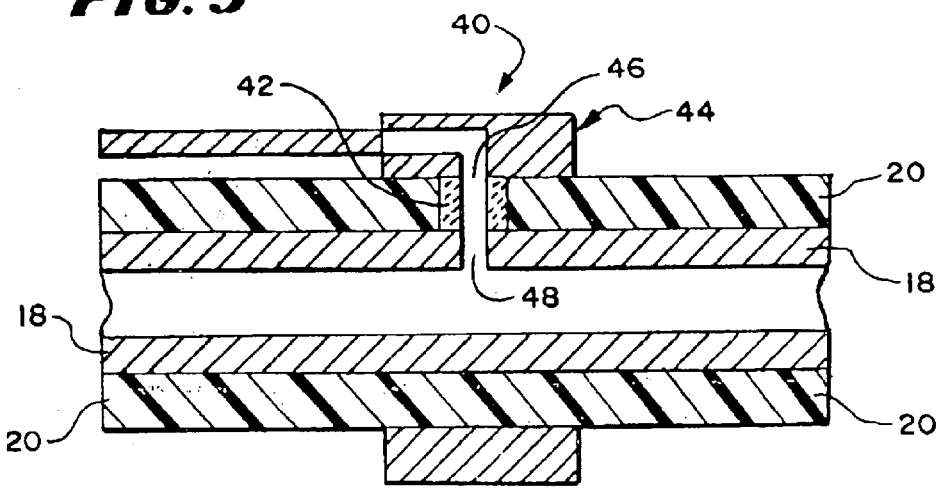
FIG. 3 is a fragmentary, simplified, sectional view of a gas port assembly mounted to a composite barrel in accordance with an aspect of the invention.

In FIG. 3, there is shown a simplified sectional view of a gas port assembly 40 having a refractory member 42, a gas conduit 46 and a gas port 48. The gas port 48 communicates with the internal bore 16 (FIGS. 1 and 2) of the composite barrel 10 through the inner wall 18 and with an operating system 44 through the gas conduit 46. The operating system 44 has internal walls forming the gas conduit 46 and is positioned between the gas conduit 46 and the composite jacket 20. With this arrangement, the composite jacket 20 is protected from the hot gas that is used to operate the cartridge loading and casing ejection mechanism.

Figure 4:
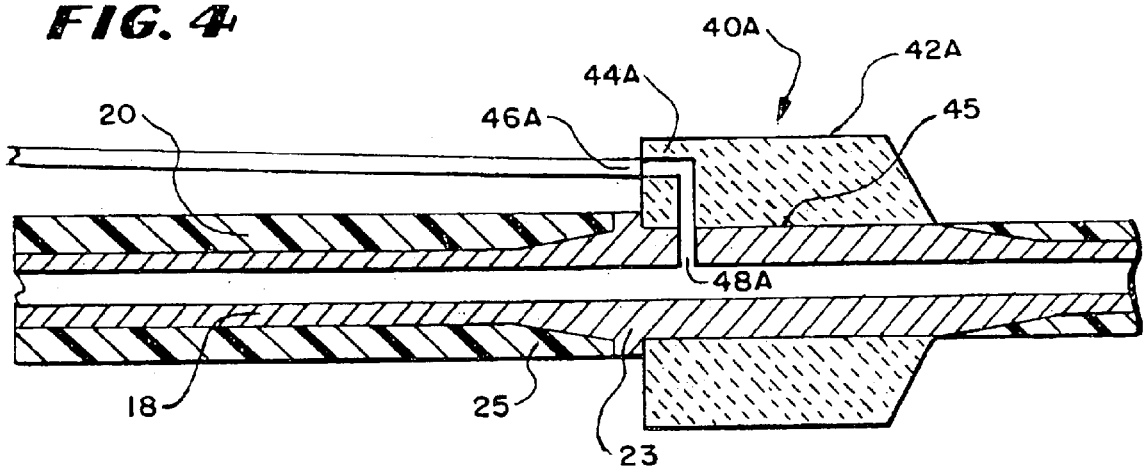
FIG. 4 is a fragmentary, simplified, sectional view of another embodiment of gas port assembly in accordance with an aspect of the invention.

In FIG. 4, there is shown a simplified longitudinal sectional view of another embodiment of a gas port assembly 40A differing from the embodiment 40 of FIG. 3 in that the inner wall 18 in the vicinity of the gas port assembly 40A increases in diameter at a transition section 25 to a full diameter section 23 unlike the inner wall 18 in the vicinity of the gas port assembly 40 of FIG. 3 which remains at the same reduced diameter. The gas port assembly 40A next to the full diameter portion 23 has a reduced section at 45 that receives a refractory gas port member 42A considered as part of the operating system 44A into which a gas conduit 46A passes for operating the cartridge injection and shell ejection mechanism. Suitable gas port blocks can be purchased commercially with the conduits already drilled in them or can be fabricated of refractory material. It may be bonded to the muzzle inner tube with suitable high temperature adhesives such as epoxy adhesives. A suitable adhesive is sold by Henkel Locetite Corp, 1001 Trout Brook Crossing, Rocky Hill, Conn. 06067 under the designaltion 9459 Hysol epoxy adhesive. With this arrangement, the fabrication is simplified because the composite is separated by the barrel material and a separate refractory insert such as shown at 42 in FIG. 3 to protect the composite is not necessary.

Figure 5:
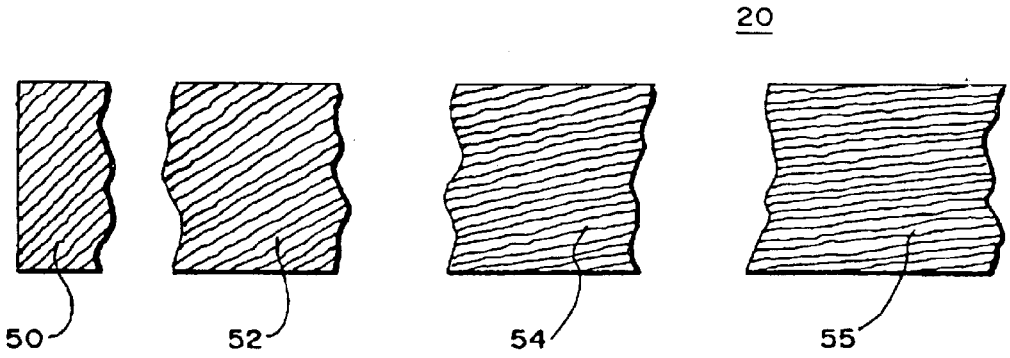
FIG. 5 is a schematic view of the composite layer showing different pitches of tows along the longitudinal axis of a structural element.

In FIG. 5, there is shown schematically, a series of portions of the composite jacket 20 illustrating the change in pitch or winding angle of the tows from a first portion 50 near the breech 12 (FIG. 1), to a portion 55 near the muzzle 28 (FIG. 1) having the first portion 50 with a relatively large winding angle close to 45 degrees, a second portion 52 with a pitch more oriented longitudinally, a third portion 54 with an acute pitch closer to the axis of the muzzle and a last portion 55 near the muzzle 28 with a pitch close to 15 degrees. The more closely aligned pitch 55 near the muzzle 28 (FIG. 1) in the preferred embodiment is 15 degrees and the pitch at the breech end 12 (FIG. 1) is 30 degrees. However, other arrangements that will avoid standing waves and resonance may be selected. In the preferred embodiment, the pitch angle is programmed to gradually change but other arrangements can be used on specific barrels to obtain the desired low amplitude bending vibrational node at the muzzle.

Figure 6:
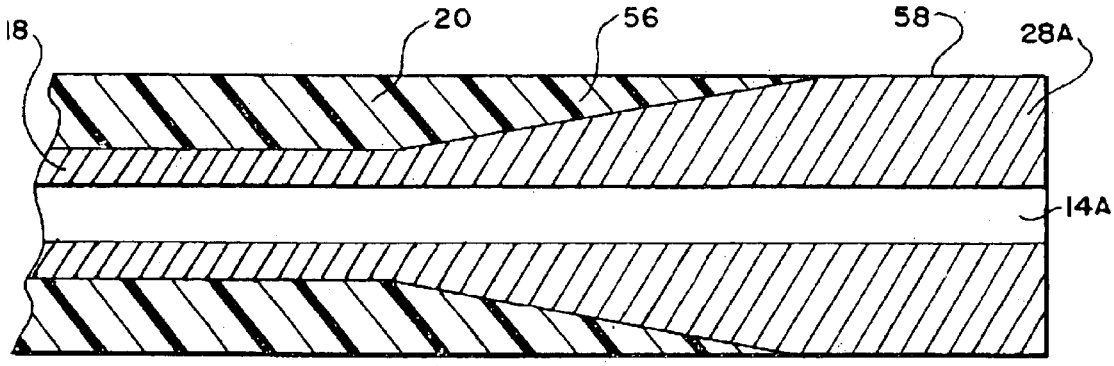
FIG. 6 is a sectional view of a muzzle end piece in accordance with an embodiment of the invention.

In FIG. 6, there is shown a sectional view of another embodiment of muzzle end piece 28A in which the end piece 28A is integrally formed with the wall 18 so that the composite material does not extend to the very end but goes through a transition section shown at 56 to a section at which there is no composite and the barrel is at full diameter at 58 at the muzzle end 14A forming the muzzle end piece 28A to protect the composite. These variations in diameter serve the function of protecting the composite and also provide an additional discontinuity to reduce the possibility of resonance and standing waves.

To make the composite structural element 10, a resin, chopped discontinuous conductive carbon fibers, and in the preferred embodiment, a gun barrel made of steel or other hard material are obtained. The barrel is machined to form one or more reduced diameter sections 26 (FIG. 1), transition sections 24 (FIG. 1) and full diameter sections 22 (FIG. 1). The resin is mixed with the discontinuous fibers, and in the preferred embodiment, the continuous tow fibers are coated with resin and discontinuous fiber mixture and wound about at least part of the cut away portion of the barrel to form a composite jacket over at least a portion of the barrel. In another embodiment, the tows are wound around the barrel first and then coated with the resin-fiber mixture to form a layer of the jacket. In both embodiments, the coated portion is then cured.

Figure 7:
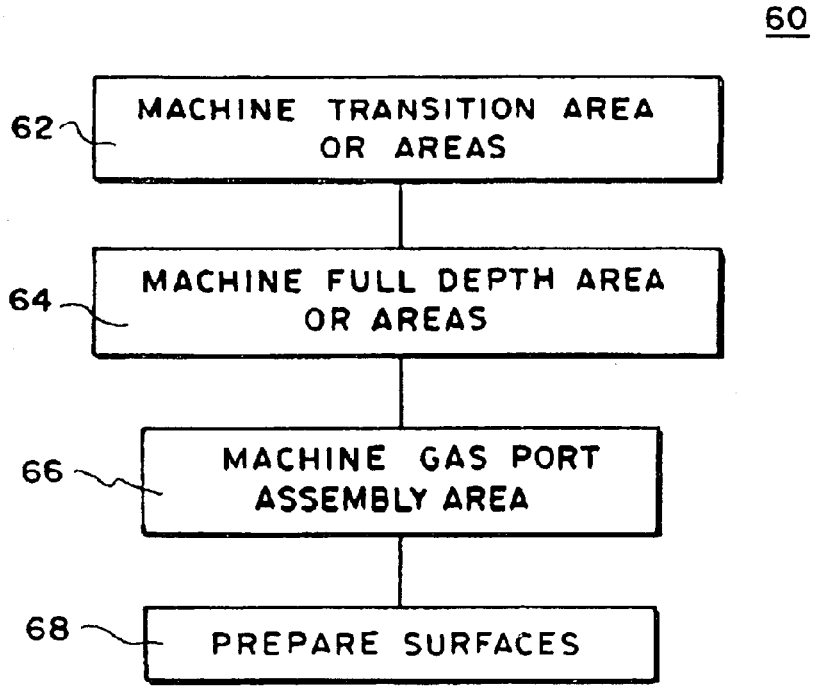
FIG. 7 is a block diagram illustrating one set of steps used in making a composite structure in accordance with the invention.

More specifically, as shown in FIG. 7, a process 60 of preparing the barrel 10 includes the step 62 of machining one or more transition sections 24 on a barrel, the step 64 of machining the full depth section or sections 26 on a barrel, the step 66 of machining the gas port assembly section 40 if there is to be a gas port assembly and the step 68 of preparing the surface to receive a composite jacket. Standard barrels can be purchased or made in a manner known to the art and are generally stainless steel or chrome molybdenum steel but can be of other hard materials such as for example tungsten carbide and ceramics. The barrels as purchased have a substantially uniform outer diameter.

The step 62 of machining transition areas includes machining the full diameter at locations at one end of those locations that are to remain at the full thickness or substantially full thickness such as at the breech end 12 to those areas that are to be thinner and receive a composite jacket. The areas that are to remain at full diameter or near full diameter are those that may be re-chambered later or sections that may be provided to protect the composite material from the hot gases the are emitted such as at the muzzle end piece 28 of the gun or on either side of the gas port 48 (FIG. 3). These transition areas reduce the tendency for excessive bending at locations where the stress changes suddenly because of a sudden change in stiffness.

The step 64 of machining the barrel to full depth includes the step of machining the outer surface of the barrel to accommodate the composite jacket. It is machined to leave at least a wall thickness of 95 thousandths and yet have a composite jacket of at least 125 thousandths. The removal of this steel makes room for a lighter composite material with different characteristics. Of particular importance to this invention is the ease in which those characteristics may be tailored while maintaining a generally cylindrical outer diameter of the barrel.

For those barrels in which there is to be no gas port and which will not be fitted for a gas operated gun, the transition area near the breech end 12 of the barrel is generally spaced to leave enough metal of sufficient thickness to the barrel for re-chambering if that is desired. The transition at the breech end 12 of the barrel generally slopes down to the thinner portion of the barrel which has a wall thickness of at least 95 thousandths in the preferred embodiment. This diameter is maintained to the next transition area. If there is no gas port assembly 40 (FIG. 3) but there is to be an muzzle end piece 28 that is not integrally formed with the barrel, the reduced thickness and increased depth to which the barrel is cut can continue to the end of the barrel. If there is to be an integrally formed muzzle end piece 28 to protect the composite material then a transition area at the muzzle end 14 of the barrel is provided so the diameter of the barrel at the muzzle is of normal size or increased size and there is no composite. The barrel material separates serve as the end piece to protect the composite and provide metal threads when desired rather than a separate muzzle piece.

If there is to be a gas port assembly 40 then the step 66 is performed. In performing this step, the gas port area is left at full diameter 23 for short abutments shown in the embodiment of FIG. 4 or the thickness of the metal portion of the barrel is kept at the reduced value in the embodiment of FIG. 3. In the embodiment of FIG. 4, the metal may be at a different thickness between full barrel diameter 23 and a thinner diameter 45 to form the gas port assembly 40A. A gas port 48 or 48A is drilled through the barrel wall to connect to the gas conduit 46 or 46A leading to the operating system 44 or 44A. The gas port assembly 40 or 40A can then be located over the gas port 48 or 48A to receive the gases for operation of the weapon.

When the barrel has been machined to the proper shape, the step 68 of preparing the surface for the composite layer is performed. In this step, the metal surface formed in the transition areas and the full depth areas is cleaned with solvents and sanded to a 150-grit finish. It is desirable to prepare the barrel in this fashion to insure a secure bond between the metallic portion and the composite matrix.

Figure 8:
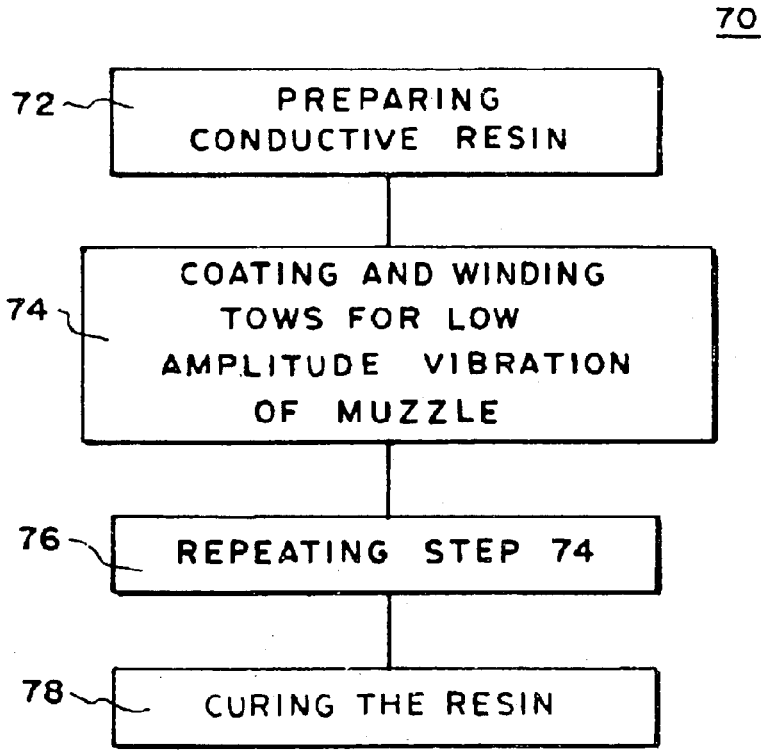
FIG. 8 is a block diagram illustrating another set of steps used in making a composite structure in accordance with the invention.

In FIG. 8, there is shown a flow diagram of a process 70 for forming a composite jacket over the prepared barrel comprising the step 72 of preparing a conductive resin, the step 74 of coating the tows and winding the coated tows onto the barrel for low amplitude vibration of the muzzle, the step 76 of repeating the coating and winding for the number of desired windings and the step 78 of curing the composite jacket.

The step 72 of preparing the conductive resin, in the preferred embodiment, comprises the steps of buying a high temperature resistive resin such as Lindan Epoxy Novalac and adding to it conductive fibers. In the preferred embodiment, the fibers are chopped carbon fibers. One source for these fibers is the aforementioned Cytec DKD-X from Cytec Carbon Fibers, LLC; 7139 Augusta Rd., Piedmont, S.C. 29673. However, there are other suitable conductive fibers and other conductive materials such as conductive carbon black that may be used. The resin is prepared so that there is in the preferred embodiment, a proportion by weight of conductive fiber to insulating resin the ratio of 0.01 to 0.4 pounds of fiber to 1 pound of resin. The tows themselves can be of the highly conductive material to cause a ratio of conductive material to nonconductive material of as high as three to two by volume.

The ingredients are mixed together and stirred so that in the case of the preferred embodiment the carbon fibers are random and uniform throughout the resin. However, it is possible to prepare a higher density of carbon fibers at the hotter locations of the barrel when the weapon is being fired such as in the vicinity of the chamber and lower density of the fibers near the muzzle end. Moreover, the fibers may be aligned radially such as by vibrating them in the presence of a radial electric field such as may be created by a strong charge between the barrel and a conductive tube over the barrel to obtain greater conductivity in the radial path.

The step 74 of winding tows for a low amplitude vibration of the muzzle comprises the step of winding helical windings in accordance with a program using a commercial winding machine in the preferred embodiment although any manner of winding the helixes with a varying pattern may be used. The pattern is chosen so that it can be repeatable and with the same barrel will result in accurate firing because the muzzle will be predictably pointing in the same direction. Generally, it is desirable to reduce vibrations, particularly harmonics and to have the muzzle positioned in a low vibration amplitude node. This is done by varying the winding speed and the pitch of the windings so that the vibrational forces are exposed at different locations in the barrel to different degrees of longitudinal, torsional and radial vibrations in a manner to reduce the bending moment of the muzzle. Many different patterns can be utilized and a trial and error method has proven to be the most satisfactory. In the preferred embodiment, the conductive resin is applied to the tows as they are being wound but they may be wound and than the resin applied.

The step 74 may be repeated and the winding pitch may be changed during each repetition. For example, it is convenient with commonly available winding equipment for the windings to be of greater pitch or lesser pitch as the winding process proceeds from one end of the barrel to the other. This is a relatively simple programming operation and different layers may be programed for the opposite variation.

Figure 9:
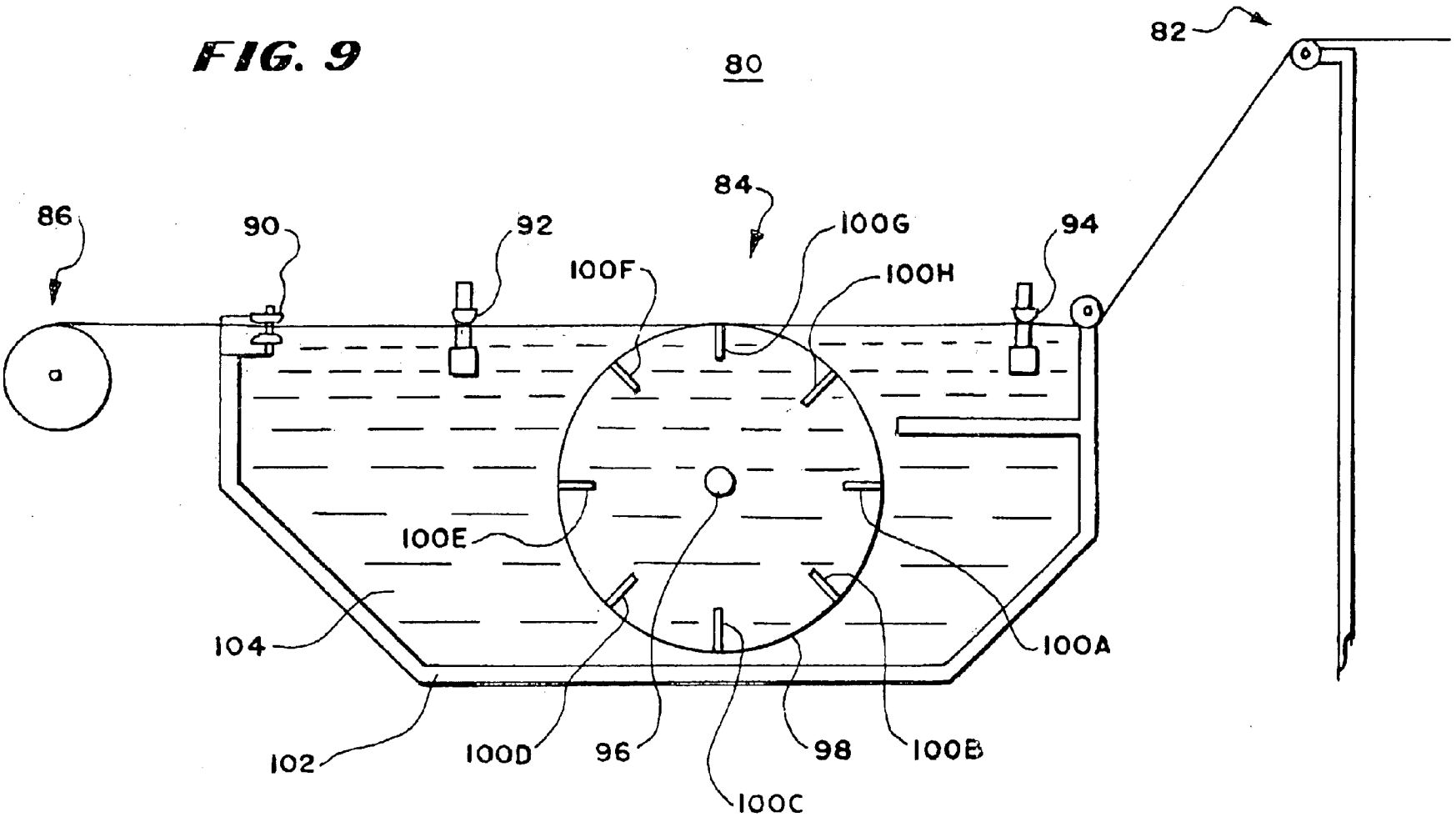
FIG. 9 is a schematic view of an apparatus for applying windings in accordance with an embodiment of the invention.

In FIG. 9, there is shown a schematic drawing of a winding apparatus 80 for forming composite structures such as composite barrels having a tow source 82, a resin applicator 84 and a winder 86. The tow source 82 supplies a plurality of tows to the resin applicator 84 to receive resin prior to being wound on the composite structure by the programmable winder 86. The resin applicator 84 maintains conductive filaments in suspension in the resin by stirring them as it applies resin to the tows. The source of tows, applicator and winder are commercially available except for the means for maintaining the conductive material in suspension.

The resin applicator 84 includes tow guides 90, 92 and 94, drum 98 and container 102 containing the drum 98 and resin and conductive material mixture. The tows are pulled across the drum 98 while being held in place by the guides 90, 92, and 94 where the resin conductive material mixture 104 is applied prior to their being wound on a structure such as a rifle barrel. The drum 98 rotates around a shaft 96 and carries with it as it rotates a plurality of agitators 100A-100H that agitate the resin conductive material mixture 104 to prevent the conductive material 104 from settling to the bottom of the container 102.

After the resin and the windings have been applied, the resin is cured in a manner known in the art in accordance with the type of resin. For example, with epoxy Novolac, the curing is done at 100 degrees Fahrenheit for one hour or 325 degrees Fahrenheit for three hours or at 375 degrees Fahrenheit for six hours.

In operation, when the gun is fired, there is a rapid heat build up near the chamber and the temperature rapidly diminishes with distance from the chamber to the muzzle end. As the vibrations pass through a section with an acute pitch with respect to the longitudinal axis of the bore, the resistance intention of the windings increases and the resistance in a radial direction and torsional resistance decreases. Similarly, as the helical windings have a more and more acute angle and/or are combined with hoops that are in a plane perpendicular to the longitudinal axis of the bore, radial pressures are restricted and torsional pressure is restricted but longitudinal movement is freer and at a lower wave length. Thus, with a very acute angle, there is a higher longitudinal wave length of vibrations and lower torsional and radial wave lengths and visa versa across a continuum. With this arrangement, the likelihood of large vibrating nodes is decreased by cancellation effects and the variety of different wave lengths across the length of the barrel. Moreover, the vibrational nodes may be adjusted by adjusting the pitch of the tows so as to locate a low amplitude vibration node directly at the muzzle so as to reduce the tenancy for it to change angles.

From the above description it can be understood that the composite barrel and method of making the composite barrel of this invention has several advantages, such as: (1) it improves accuracy and reduces the amplitude of vibrations at the muzzle; (2) it aids in the dissipation of heat and reduces the tendency of the barrel to overheat; and (3) it can be formed reliably and predictably with desirable characteristics in an economical manner.

Although a preferred embodiment of the invention has been described with some particularity, it is to be understood that many variations of the embodiment are possible within the light of the above teachings. Therefore, it is to be understood that within the scope of the appended claims, the invention may be practiced other than as specifically described.

What is claimed is:

1. A composite gun barrel, comprising:

a lightweight internal barrel section;

said internal barrel section having solid tubular internal walls of a strong material defining a bore with a longitudinal bore axis;

an external barrel section;

said external barrel section comprising a composite overlay on said lightweight internal barrel section;

said external barrel section including a resin, fiber tows and thermally conductive filler, whereby said composite gun barrel resists overheating.

2. A composite gun barrel, comprising:

a lightweight internal barrel section;

said internal barrel section having solid tubular internal walls of a strong material defining a bore with a longitudinal bore axis;

an external barrel section;

said external barrel section comprising a composite overlay on said lightweight internal barrel section;

said external barrel section including a resin, fiber tows and thermally conductive filler, whereby said composite gun barrel resists overheating, wherein the conductive filler is comprised of a plurality of randomly oriented discontinuous heat conductive fibers embedded in the resin.

3. A composite gun barrel, comprising:

a lightweight internal barrel section;

said internal barrel section having solid tubular internal walls of a strong material defining a bore with a longitudinal bore axis;

an external barrel section;

said external barrel section comprising a composite overlay on said lightweight internal barrel section;

said external barrel section including a resin, fiber tows and thermally conductive filler, whereby said composite gun barrel resists overheating, wherein the fiber tows form at least one layer of a continuous fiber with a helical pitch that varies along the length of the composite gun barrel in a manner to avoid resonance vibrations and standing waves.

4. A composite gun barrel according to claim 3 wherein the at least one layer of a continuous fiber with a helical pitch comprises at least one layer with an accelerating and decelerating pitch along the length of the barrel.

5. A composite gun barrel according to claim 3 wherein said at least one layer of a continuous fiber with a helical pitch includes a plurality of layers of continuous fiber with a helical pitch and said plurality of layers of continuous fiber includes a layer with one of an accelerating or decelerating helix pattern of greater than 5 degrees to less than 89 degrees to an axis of the barrel.

6. A composite gun barrel according to claim 3 in which a plurality of said at least one layer of a continuous fiber with a helical pitch are intermixed with consolidating hoops or 90 degrees layers.

7. A composite gun barrel, comprising:

a lightweight internal barrel section;

said internal barrel section having solid tubular internal walls of a strong material defining a bore with a longitudinal bore axis;

an external barrel section;

said external barrel section comprising a composite overlay on said lightweight internal barrel section;

said external barrel section including a resin, fiber tows and thermally conductive filler, whereby said composite gun barrel resists overheating, a muzzle piece of metallic material to protect the composite overlay and provide for or protect accessory threads.

8. A composite gun barrel according to claim 7 in which the muzzle piece is a separate tubular member.

9. A composite gun barrel according to claim 7 in which the muzzle piece is integrally formed with the barrel.

10. A composite gun barrel according to claim 3 in which the composite gun barrel further includes a breech area, said breech area further including enough metallic material to allow for major chamber modifications, commonly known to those skilled in the art as selling back a barrel for rechambering.

11. A composite gun barrel in accordance with claim 3 wherein the internal barrel section has a wall thickness of at least 0.095 inch whereby it is self supporting.

12. A composite gun barrel in accordance with claim 3 further including a gas port, a gas conduit between the gas port and an operating system; said gas conduit further including refractory means forming a gas wall between the gas port and the operating system, wherein a protective pathway facilitates gas flow to the operating system without eroding the composite overlay.

13. A composite gun barrel in accordance with claim 12, wherein the refractory means is steel.

14. A composite gun barrel in accordance with claim 12, wherein the refractory means is tungsten carbide.

15. A composite gun barrel in accordance with claim 12 wherein the refractory means is ceramic.

16. A composite gun barrel in accordance with claim 12 wherein a portion of an underlying metallic barrel material remains an integral part of the finished outside diameter to facilitate gas transfer to the operating system without contacting the composite overlay.

17. A composite gun barrel in accordance with claim 1 in which the thermally conductive filler has a conductivity no lower than 75 watts per meter per degree Kelvin.

18. A composite gun barrel in accordance with claim 1 in which the thermally conductive filler is chopped pitch based fibers.

19. A composite gun barrel in accordance with claim 1 in which the thermally conductive filler and resin are in the ratio of 0.01 to 0.4 pounds of thermally conductive filler to 1 pound of resin.

20. A composite gun barrel, comprising:

an internal barrel section;

said internal barrel section having solid tubular internal walls of a strong material defining a bore with a longitudinal bore axis;

an external barrel section;

said external barrel section comprising a composite overlay on said internal barrel section;

said external barrel section including a resin and fiber tows, wherein the tows form at least one layer with a helical pitch that varies along the length of the composite barrel in a manner to reduce the amplitude of vibrations of a muzzle.

21. A composite gun barrel, comprising:

an internal barrel section;

said internal barrel section having solid tubular internal walls of a strong material defining a bore with a longitudinal bore axis;

an external barrel section;

said external barrel section comprising a composite overlay on said internal barrel section;

said external barrel section including a resin and fiber tows, wherein the tows form at least one layer with a helical pitch that varies along the length of the composite barrel in a manner to reduce the amplitude of vibrations of a muzzle, wherein said at least one layer with a helical pitch comprises at least one layer with an accelerating and decelerating pitch along the length of the barrel.

22. A composite gun barrel, comprising:

an internal barrel section;

said internal barrel section having solid tubular internal walls of a strong material defining a bore with a longitudinal bore axis;

an external barrel section;

said external barrel section comprising a composite overlay on said internal barrel section;

said external barrel section including a resin and fiber tows, wherein the tows form at least one layer with a helical pitch that varies along the length of the composite barrel in a manner to reduce the amplitude of vibrations of a muzzle, wherein said at least one layer with a helical pitch includes a plurality of layers of continuous fiber with a helical pitch and said plurality of layers of continuous fiber with a helical pitch includes a layer with one of an accelerating or decelerating helix pattern of greater than 5 degrees to less than 89 degrees to the axis of the barrel.

23. A composite barrel, comprising:

an internal barrel section;

said internal barrel section having solid tubular internal walls of a strong material defining a bore with a longitudinal bore axis;

an external barrel section;

said external barrel section comprising a composite overlay on said internal barrel section;

said external barrel section including a resin and fiber tows, wherein the tows form at least one layer with a helical pitch that varies along the length of the composite barrel in a manner to reduce the amplitude of vibrations of a muzzle, wherein at least one of said helical layers includes intermixed consolidating hoops of 90 degrees.

24. A composite gun barrel, comprising:

an internal barrel section;

said internal barrel section having solid tubular internal walls of a strong material defining a bore with a longitudinal bore axis;

an external barrel section;

said external barrel section comprising a composite overlay on said internal barrel section;

said external barrel section including a resin and fiber tows, wherein the tows form at least one layer with a helical pitch that varies along the length of the composite barrel in a manner to reduce the amplitude of vibrations of a muzzle, wherein the external barrel section includes chopped pitch based carbon conductive fiber embedded in the resin.

25. A composite gun barrel, comprising:

an internal barrel section;

said internal barrel section having solid tubular internal walls of a strong material defining a bore with a longitudinal bore axis;

an external barrel section;

said external barrel section comprising a composite overlay on said internal barrel section;

said external barrel section including a resin and fiber tows, wherein the tows form at least one layer with a helical pitch that varies along the length of the composite barrel in a manner to reduce the amplitude of vibrations of a muzzle, a muzzle piece of metallic material to protect the composite overlay and provide for or protect accessory threads.

26. A composite gun barrel according to claim 25 in which the muzzle piece is a separate tubular member.

27. A composite gun barrel according to claim 25 in which the muzzle piece is intrinsically formed with the barrel.

28. A composite gun barrel, comprising:

an internal barrel section;

said internal barrel section having solid tubular internal walls of a strong material defining a bore with a longitudinal bore axis;

an external barrel section;

said external barrel section comprising a composite overlay on said internal barrel section;

said external barrel section including a resin and fiber tows, wherein the tows form at least one layer with a helical pitch that varies along the length of the composite barrel in a manner to reduce the amplitude of vibrations of a muzzle, the gun barrel further includes a breech area, said breech area further including enough metallic material to allow for major chamber modifications, commonly known to those skilled in the art as setting back a barrel for rechambering.

29. A composite gun barrel, comprising:

an internal barrel section;

said internal barrel section having solid tubular internal walls of a strong material defining a bore with a longitudinal bore axis;

an external barrel section;

said external barrel section comprising a composite overlay on said internal barrel section;

said external barrel section including a resin and fiber tows, wherein the tows form at least one layer with a helical pitch that varies along the length of the composite barrel in a manner to reduce the amplitude of vibrations of a muzzle, wherein the internal barrel section has a wall thickness of at least 0.095 inch whereby it is self supporting.

30. A composite gun barrel, comprising:

an internal barrel section;

said internal barrel section having solid tubular internal walls of a strong material defining a bore with a longitudinal bore axis;

an external barrel section;

said external barrel section comprising a composite overlay on said internal barrel section;

said external barrel section including a resin and fiber tows, wherein the tows form at least one layer with a helical pitch that varies along the length of the composite barrel in a manner to reduce the amplitude of vibrations of a muzzle, a gas port, a gas conduit between the gas port and an operating system;

said gas conduit further including refractory means forming a gas wall between the gas port and the operating system, wherein a protective pathway facilitates gas flow to the operating system without eroding the composite overlay.

31. A composite gun barrel in accordance with claim 30, wherein the refractory means is steel.

32. A composite gun barrel in accordance with claim 30, wherein the refractory means is tungsten carbide.

33. A composite gun barrel in accordance with claim 30, wherein the refractory means is ceramic.

* * * * *